US009535399B2

(12) United States Patent
Wakimoto

(10) Patent No.: US 9,535,399 B2
(45) Date of Patent: Jan. 3, 2017

(54) IMAGE FORMING DEVICE

(71) Applicant: KYOCERA Document Solutions Inc., Osaka (JP)

(72) Inventor: Atsuhiro Wakimoto, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/137,433

(22) Filed: Apr. 25, 2016

(65) Prior Publication Data

US 2016/0313694 A1 Oct. 27, 2016

(30) Foreign Application Priority Data

Apr. 27, 2015 (JP) ..... 2015-090770

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01); *G03G 15/2028* (2013.01)

(58) Field of Classification Search
USPC ..... 399/91, 92, 93, 98
See application file for complete search history.

(56) References Cited

U.S. PATENT DOCUMENTS 7,715,747 B2 * 5/2010 Kitozaki ..... G03G 21/206 399/69
8,218,996 B2 * 7/2012 Shimizu ..... G03G 15/6573 399/92
8,725,025 B2 * 5/2014 Murasaki ..... G03G 15/2017 399/92
8,903,265 B2 * 12/2014 Kubo ..... G03G 21/206 399/92

FOREIGN PATENT DOCUMENTS

JP S59-138863 U 9/1984
JP S63-201730 U 12/1988

* cited by examiner

*Primary Examiner* — Hoan Tran
(74) *Attorney, Agent, or Firm* — IP Business Solutions, LLC

(57) ABSTRACT

An image forming device includes: a fixing unit fixing a toner image to a paper sheet after image formation; a conveying path conveying the paper sheet toward and from the fixing unit; a cooling fan disposed at a position facing the conveying path that is downstream relative to the fixing unit in a paper conveying direction; a casing where the cooling fan is accommodated; a first discharge port discharging cooling air from the cooling fan toward a part of the conveying path that is upstream in the paper conveying direction relative to an end portion of the conveying path in the conveying path, which is downstream relative to the fixing unit; and a duct guiding the cooling air from the cooling fan in a direction toward the end portion of the conveying path, which is different from a direction that the cooling air flows in the first discharge port.

12 Claims, 6 Drawing Sheets

IMAGE FORMING DEVICE

INCORPORATION BY REFERENCE

This application claims priority to Japanese Patent Application No. 2015-090770 filed on Apr. 27, 2015, the entire contents of which are incorporated by reference herein.

BACKGROUND

The present disclosure relates to an image forming device, and particularly, to a technology for cooling a paper sheet and preventing water droplets from adhering.

As a general image forming device, a device using an electrophotographic method is well known. The electrophotographic method includes five processes, for example, a charging process in which a photoreceptor having no electrical charge is uniformly charged, an exposure process in which laser light is emitted to an electrically charged photoreceptor surface based on a copy document, and a latent image of the document is formed on the photoreceptor surface, a developing process in which the latent image is visualized with toner, a transfer process in which a toner image formed by visualization is transferred to a recording medium such as a paper sheet placed on a transfer belt, and a fixing process in which the transferred toner image is fixed to the recording medium.

Here, in the fixing process, when the toner is fixed to the paper sheet, heat above a high temperature of 100 to 180° C. and pressure are applied to the paper sheet by a fixing unit. However, when the paper sheet that underwent the fixing process is discharged to a discharge tray, and several tens of sheets of paper overlap at a high temperature, heat of the paper sheet does not dissipate, and the toner that was fixed once is attached to other overlapping sheets of paper. Such a situation is highly likely to occur as a printing speed increases. When the printing speed increases, a fixing temperature increases, the discharged sheets of paper are successively stacked, and a time for which the discharged paper sheet is exposed to outside air decreases.

In addition, when heat is applied to the paper sheet, moisture contained in the paper sheet is evaporated to water vapor, and becomes water droplets that adhere to a component configured to convey the paper sheet, and the water droplets accumulate on the component. Therefore, when the accumulated water droplets adhere to the paper sheet, there is a problem in that a printed image is blurred. In particular, since the paper sheet does not pass a conveying path or a conveying roller (for example, a switchback roller) for double-sided printing when single-sided printing is performed, water droplets are likely to accumulate.

As technologies for preventing water droplets from accumulating, for example, there is a technology for condensing and collecting generated water vapors. A technology for releasing the generated water vapors to an atmosphere is also proposed. In addition, recently, it is considered to be effective to provide a cooling fan and apply cooling air to a location that needs to be cooled.

SUMMARY

As an aspect of the present disclosure, a further improved technology than the above technologies is proposed.

An image forming device according to an aspect of the present disclosure includes a fixing unit, a conveying path, a cooling fan, a casing, a first discharge port and a duct.

The fixing unit fixes a toner image to a paper sheet after image formation. The conveying path conveys the paper sheet toward the fixing unit and from the fixing unit.

The cooling fan is disposed at a position facing the conveying path that is downstream relative to the fixing unit in a paper conveying direction.

The cooling fan is accommodated in the casing.

The first discharge port is formed in the casing, and discharges cooling air from the cooling fan toward a part of the conveying path that is upstream in the paper conveying direction relative to an end portion of the conveying path in the conveying path, which is downstream relative to the fixing unit.

The duct guides the cooling air from the cooling fan in a direction toward the end portion of the conveying path which is different from a direction in which the cooling air flows in the first discharge port.

DETAILED DESCRIPTION

Figure 1:
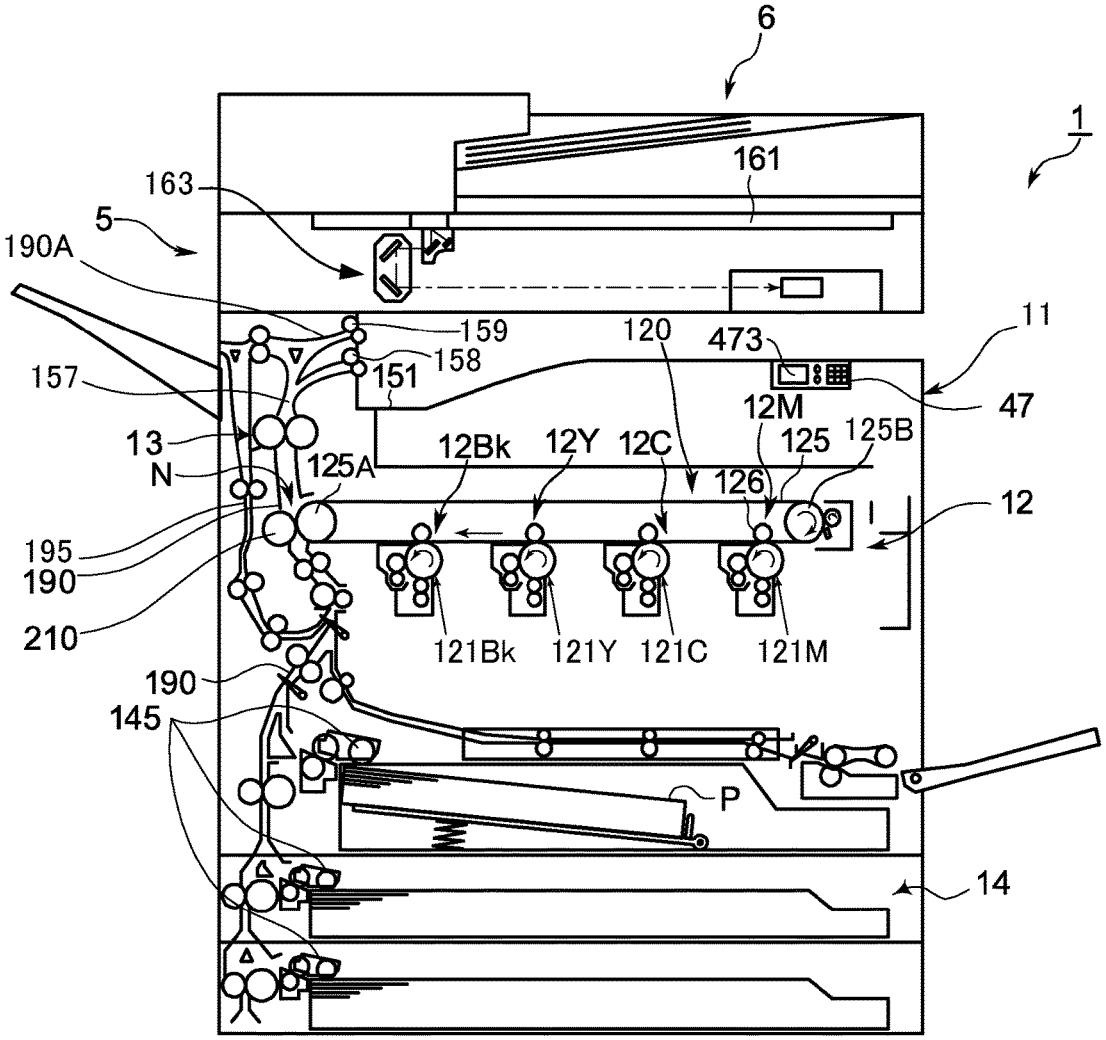
FIG. 1 is a partial cross-sectional front view schematically illustrating a structure of an image forming device according to a first embodiment of the present disclosure.

Hereinafter, an image forming device and a cooling unit according to an embodiment of the present disclosure will be described with reference to the drawings. FIG. 1 is a partial cross-sectional front view schematically illustrating a structure of an image forming device according to a first embodiment of the present disclosure.

An image forming device 1 according to an embodiment of the present disclosure is a multifunctional device having a plurality of functions, for example, a copy function, a printer function, a scanner function, and a facsimile function. The image forming device 1 has a device body 11 that includes a paper feeding unit 14 having a pickup roller 145, an operating unit 47, a display unit 473, a document feeding unit 6, and a document reading unit 5.

A case in which a document reading operation is performed in the image forming device 1 will be described. An image of a document fed by the document feeding unit 6 or a document placed on a document placing glass 161 is optically read by the document reading unit 5 having a reading mechanism 163 and image data is then generated.

An image forming unit 12 includes an image forming unit 12Bk for black (Bk), an image forming unit 12Y for yellow (Y), an image forming unit 12C for cyan (C), and an image forming unit 12M for magenta (M). The image forming units 12Bk, 12Y, 12C, and 12M include drum type photoreceptors 121Bk, 121Y, 121C, and 121M, respectively. The photoreceptors 121Bk, 121Y, 121C, and 121M are driven to rotate in a counterclockwise direction in the drawing.

A transfer unit 120 includes an intermediate transfer belt 125 on which a toner image is transferred to an outer circumferential surface thereof, a driving roller 125A, a driven roller 125B, and a primary transfer roller 126. The intermediate transfer belt 125 is stretched between the driving roller 125A and the driven roller 125B, is driven by the driving roller 125A in contact with circumferential surfaces of the photoreceptors 121Bk, 121Y, 121C, and 121M, and endlessly travels in synchronization with the photoreceptors 121Bk, 121Y, 121C, and 121M.

A case in which color printing is performed will be described. In a charging process, the surroundings of the photoreceptors 121Bk, 121Y, 121C, and 121M are uniformly charged. In an exposure process, based on image data, laser light is emitted to surfaces of the electrically charged photoreceptors 121Bk, 121Y, 121C, and 121M, and a latent image is formed. In a developing process, the latent image is visualized with toner. In a transfer process, a toner image formed by the visualization is transferred onto the intermediate transfer belt 125 by the primary transfer roller 126. Each toner image of colors (black, yellow, cyan, and magenta) is transferred onto the intermediate transfer belt 125 and overlaps on the intermediate transfer belt 125 at a transfer timing that is adjusted to become a color toner image.

A secondary transfer roller 210 transfers the color toner image formed on the surface of the intermediate transfer belt 125 to a paper sheet P conveyed along a conveying path 190 from the paper feeding unit 14 at a nip portion N of the driving roller 125A with the intermediate transfer belt 125 interposed therebetween.

A fixing unit 13 fixes the toner image to the paper sheet P by thermocompression. The image-formed paper sheet P that underwent the fixing process is conveyed along a conveying path 157, and discharged to a discharge tray 151 by a discharge roller 158.

A case in which double-sided printing is performed in the image forming device 1 will be described. In the conveying path 190, a switchback conveying path 190A branched from the conveying path 190 at a point that is upstream relative to the discharge roller 158 in a paper conveying direction is provided. The paper sheet P having one side on which an image is formed by the image forming unit 12 is switched back by a switchback roller 159 provided at an end portion of the switchback conveying path 190A, and delivered to a switchback conveying path 195. The paper sheet P is conveyed again to an upstream region in a conveying direction by a pair of conveying rollers. That is, the switchback conveying path 195 conveys the paper sheet P switched back by the switchback roller 159 again to a position that is upstream in the paper conveying direction relative to a position at which the image is formed on the paper sheet P by the image forming unit 12 (the nip portion N) in the conveying path 157. Accordingly, it is also possible to form an image on the other side of the paper sheet P.

Also, although not illustrated herein, a cooling fan 101 (FIG. 2) configured to cool the conveying path 157 along which the paper sheet P that underwent the fixing process performed by the fixing unit 13 is conveyed and the switchback roller 159 is arranged at an upper position (a position facing the conveying path 157 that is downstream in the paper conveying direction of the conveying path 190) of the fixing unit 13.

Figure 2:
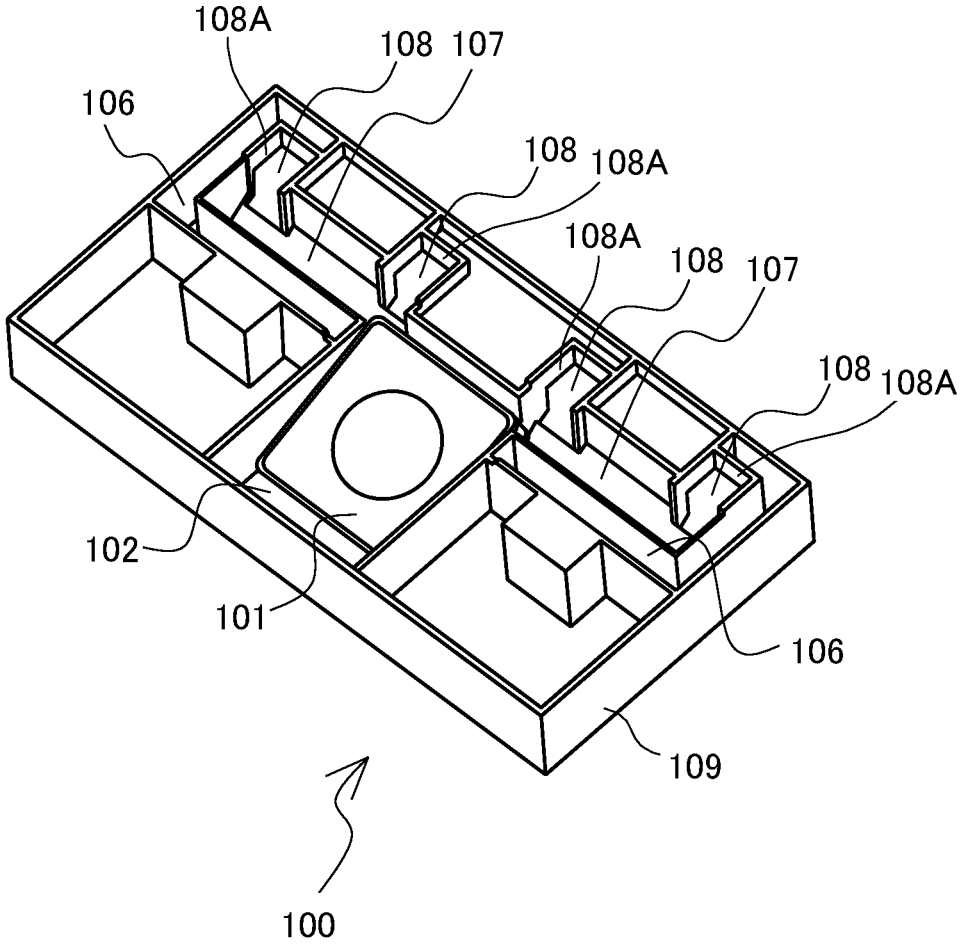
FIG. 2 is a perspective view schematically illustrating a cooling unit provided in the image forming device according to the first embodiment of the present disclosure.
Figure 3A:
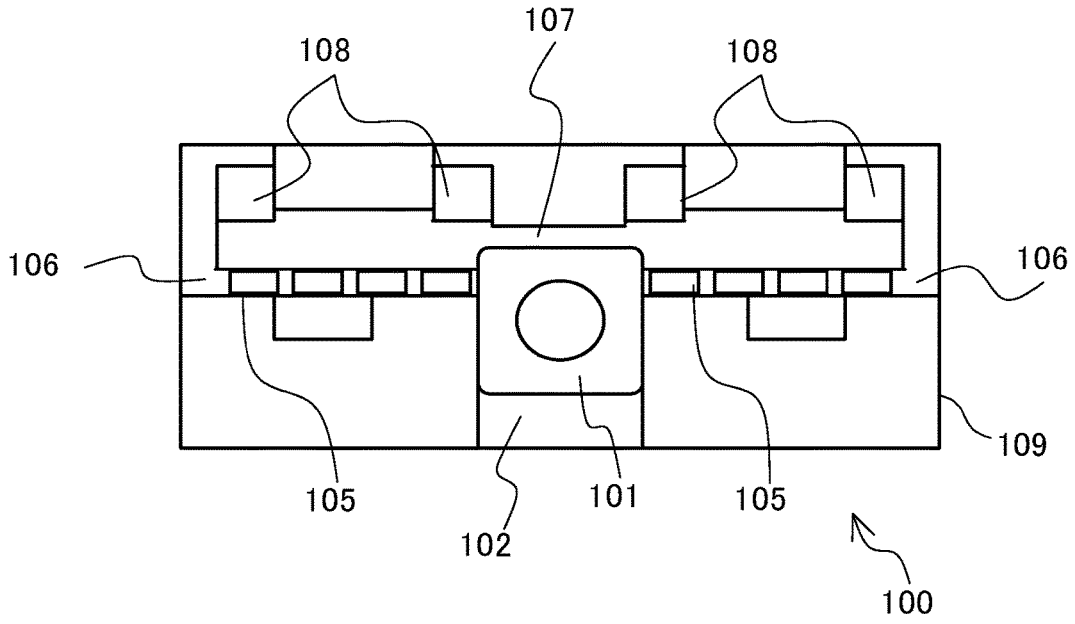
FIG. 3A is a plan view schematically illustrating a cooling unit and illustrates a state in which a cooling fan is mounted.
Figure 3B:
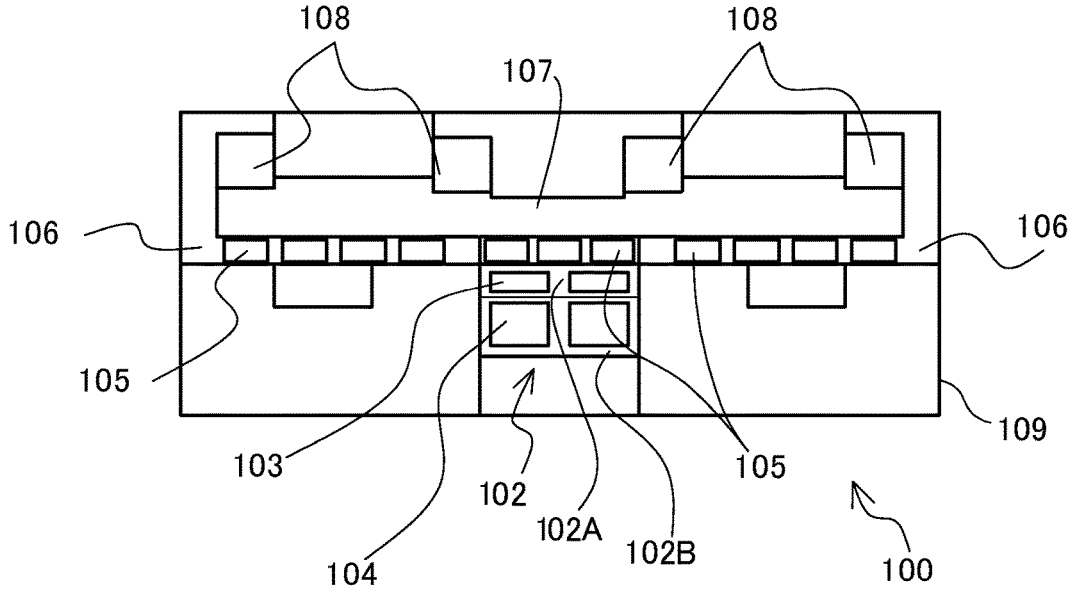
FIG. 3B is a plan view schematically illustrating a cooling unit and illustrates a state in which a cooling fan is removed.
Figure 4:
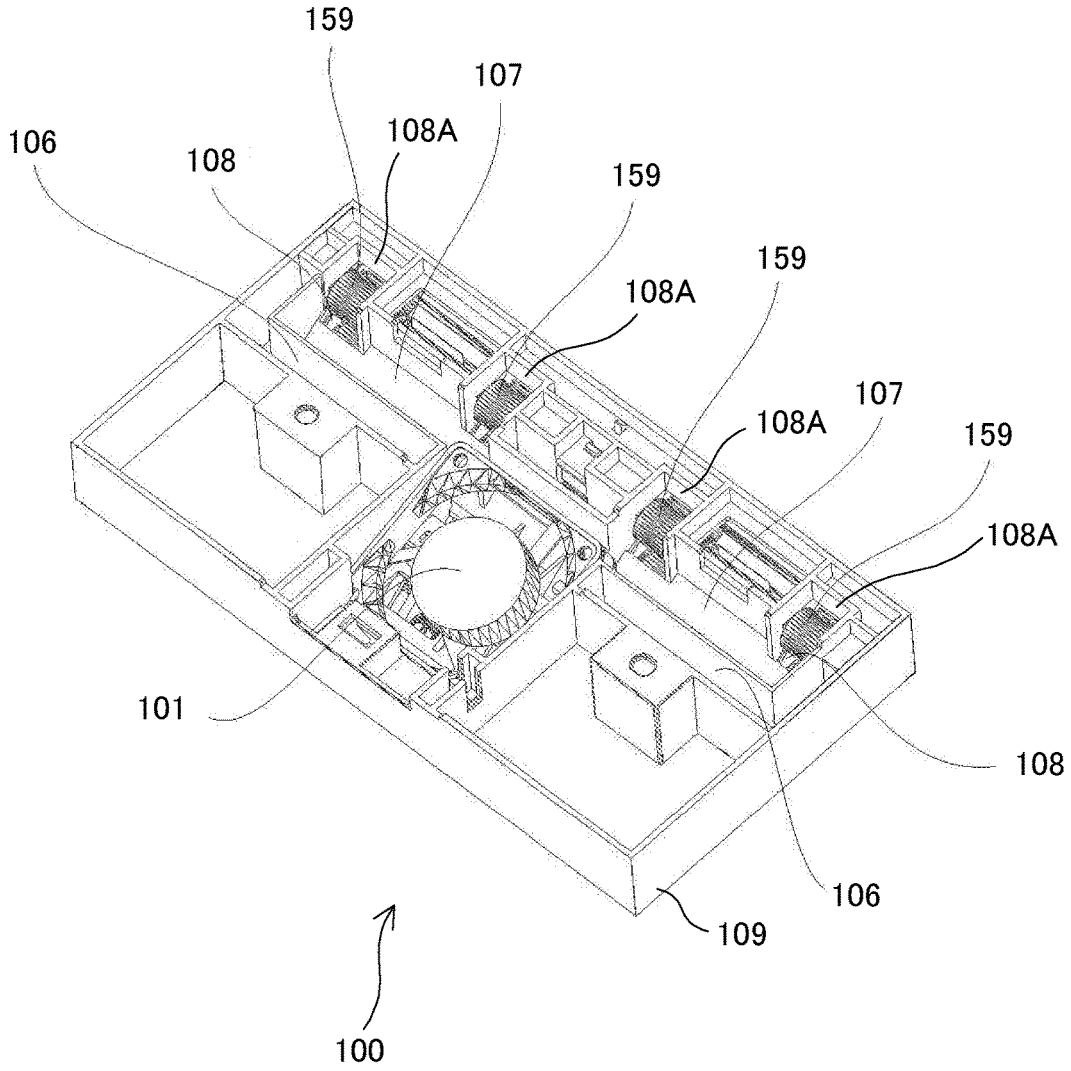
FIG. 4 is a perspective view schematically illustrating a cooling unit while a switchback roller is accommodated.

FIG. 2 is a perspective view schematically illustrating a cooling unit provided in the image forming device according to a first embodiment of the present disclosure. In addition, FIGS. 3A and 3B are plan views schematically illustrating a cooling unit. FIG. 3A illustrates a state in which a cooling fan is mounted. FIG. 3B illustrates a state in which a cooling fan is removed. FIG. 4 is a perspective view schematically illustrating a cooling unit 100 while the switchback roller 159 is accommodated.

The cooling unit 100 includes a casing in which the cooling fan 101 and the switchback roller 159 are accommodated, a fan mounting portion 102 on which the cooling fan 101 is mounted, and a concave portion 106 that is arranged to face the conveying path 157 (FIG. 1) along which the paper sheet that underwent the fixing process is conveyed. A plurality of discharge ports (a furthest downstream discharge port) 105 serving as openings through which cooling air from the cooling fan 101 is discharged are formed at the bottom of the concave portion 106. Further, the cooling unit 100 includes a duct 107. The duct 107 guides the cooling air from the cooling fan 101 in a direction toward an end portion of the conveying path 157, which is different from a direction in which the cooling air flows in the discharge port 105. The concave portion 106 extends toward the conveying path 157 along which the paper sheet P that underwent the fixing process performed by the fixing unit 13 is conveyed. The discharge port 105 is formed at a position facing the conveying path 157 in the concave portion 106. The discharge port 105 is formed in a width direction of the paper sheet P in a casing 109. In the present embodiment, a plurality of the discharge ports 105 is formed in the width direction.

In addition, in the fan mounting portion 102 whose cross section has a stair shape, as illustrated in FIG. 3B, a discharge port (an intermediate position discharge port) 103 having a short longitudinal length, which serves as an opening through which the cooling air from the cooling fan 101 is discharged, is formed on an upper surface 102A, and a discharge port (a furthest upstream discharge port) 104 having a long longitudinal length is formed on a lower surface 102B. In the casing 109, the discharge port 104 and the discharge port 103 are formed at a center portion in the width direction of the paper sheet P conveyed along the conveying path 157. The duct 107 is linked from a part at which the cooling fan 101 discharges cooling air, and extends in the width direction (a rotation axis direction of the discharge roller 158 and the switchback roller 159) of the paper sheet to be conveyed, which is a direction perpendicular to the direction in which the paper sheet is conveyed along the conveying paths 157 and 190. Furthermore, the duct 107 is branched at a plurality of positions in the width direction of the paper sheet. A discharge port 108 is formed at a branch destination of the duct 107. The discharge port 104 is formed furthest upstream in the paper conveying direction. The discharge port 105 is formed furthest downstream in the paper conveying direction. The discharge port 103 is formed at an intermediate position between the discharge port 104 and the discharge port 105.

The switchback roller 159 is provided to be divided at a plurality of positions in the width direction at a rotating shaft 1591 that extends in the width direction of the paper sheet. The duct 107 extends along the rotating shaft 1591 of the switchback roller 159. The discharge port 108 is provided at a position at which each of the plurality of switchback rollers 159 provided at the rotating shaft 1591 is disposed.

The discharge port 108 is capable of accommodating the switchback roller 159 (FIG. 4). That is, the duct 107 guides the cooling air of the cooling fan 101 toward the switchback roller 159.

However, the duct 107 may be formed to guide the cooling air of the cooling fan 101 toward the discharge roller 158 or toward both the discharge roller 158 and the switchback roller 159. In the present embodiment, the discharge port 108 of the duct 107 has a structure in which the switchback roller 159 is accommodated, but a bottom of the discharge port 108 is opened, cooling air is guided to the switchback roller 159, and the cooling air is supplied to the discharge roller 158 positioned below the switchback roller 159.

Note that the discharge port 105 formed at the concave portion 106 and the discharge ports 103 and 104 formed at the fan mounting portion 102 are examples of a first discharge port in the scope of the claims. That is, the discharge port 105, and the discharge ports 103 and 104 discharge the cooling air from the cooling fan 101 toward a part of the conveying path 157 that is upstream in the paper conveying direction relative to the end portion of the conveying path 157 (near a position at which the discharge roller 158 is disposed), which is downstream relative to the fixing unit 13. The discharge port 108 formed at the branch destination of the duct 107 is an example of a second discharge port in the scope of the claims.

As illustrated in FIG. 4, the switchback roller 159 is accommodated in the discharge port 108 formed at the branch destination of the duct 107. Accordingly, the cooling air from the cooling fan 101 guided by the duct 107 hits the switchback roller 159 in the discharge port 108 with high efficiency. The discharge port 108 has a bottom that is opened and the discharge roller 158 is arranged thereunder. Cooling air led to the discharge port 108 is guided downward by a sidewall 108A of the discharge port 108, and reaches the discharge roller 158. Accordingly, cooling air also hits the discharge roller 158.

Figure 5:
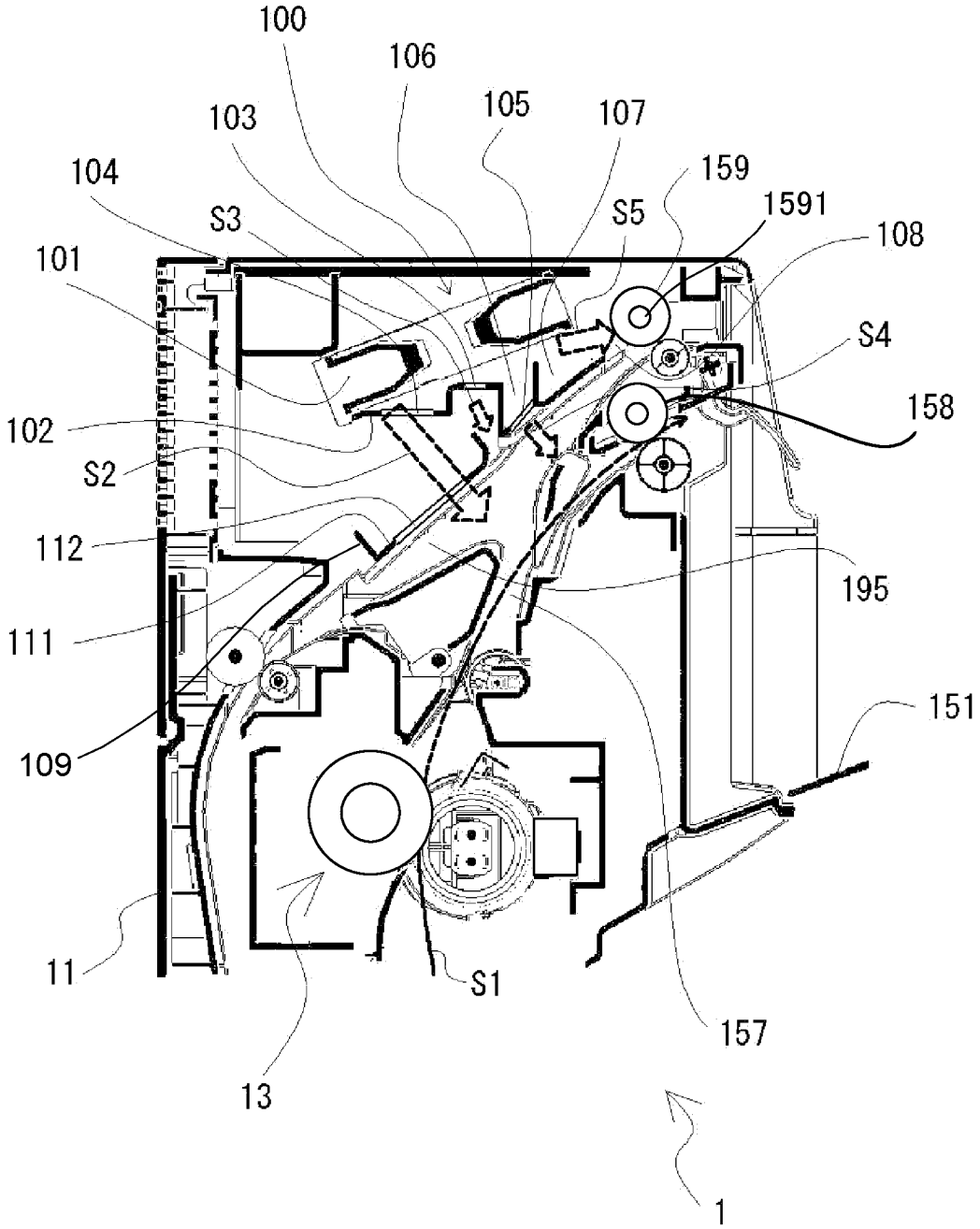
FIG. 5 is a partial cross-sectional front view schematically illustrating a periphery of a fixing unit of an image forming device in which a cooling unit is provided.
Figure 6:
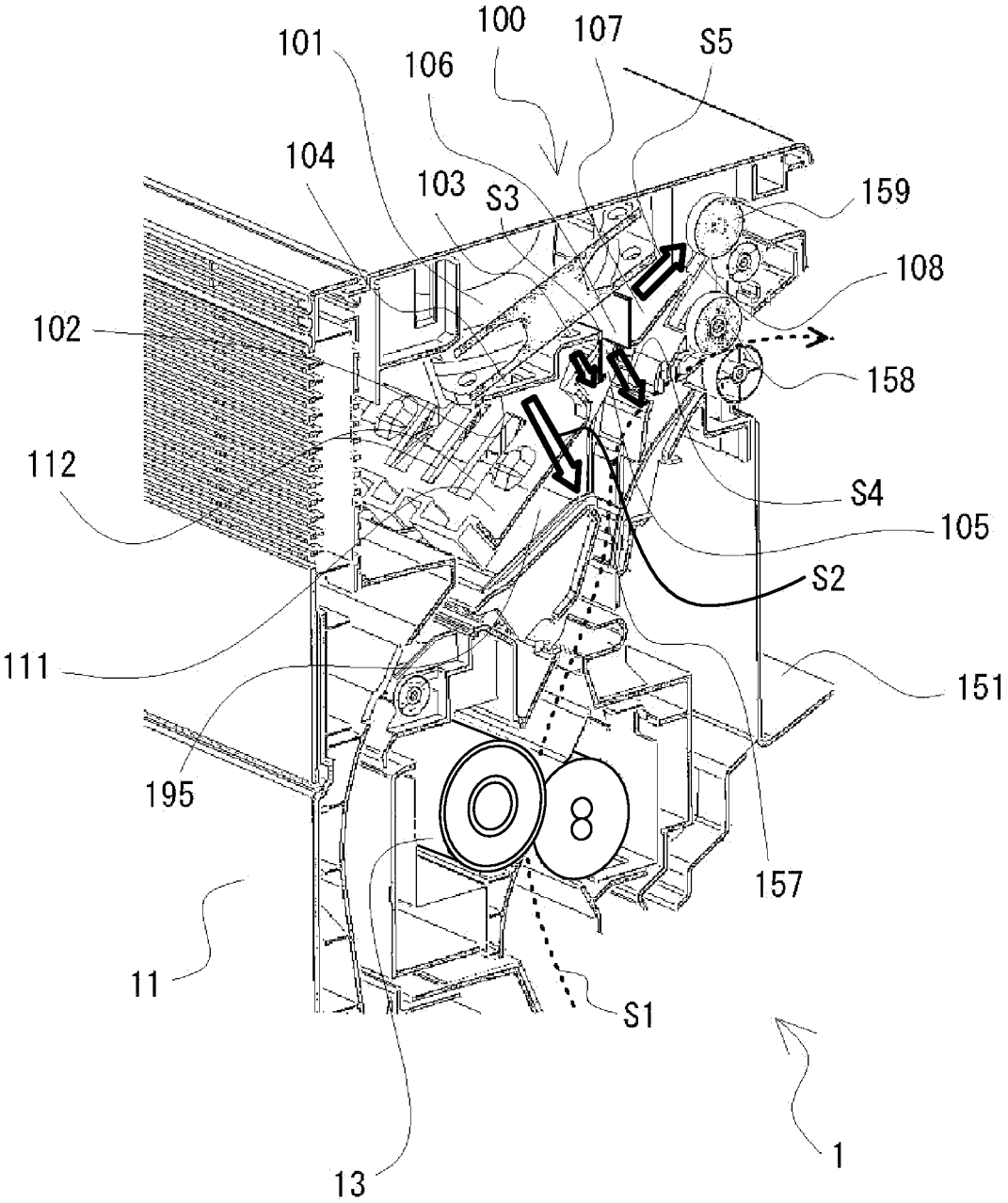
FIG. 6 is a partial cross-sectional perspective view schematically illustrating a periphery of a fixing unit of an image forming device in which a cooling unit is provided.

FIG. 5 is a partial cross-sectional front view schematically illustrating a periphery of the fixing unit 13 of the image forming device 1 in which the cooling unit 100 is provided. FIG. 6 is a partial cross-sectional perspective view schematically illustrating a periphery of the fixing unit 13 of the image forming device 1 in which the cooling unit 100 is provided.

At a guide member 111 arranged below the cooling unit 100 along the switchback conveying path 195, a plurality of slits 112 serving as openings through which cooling air discharged from the discharge ports 103 and 104, which are formed at the fan mounting portion 102 of the cooling unit 100, and the discharge port 105 passes are formed in a longitudinal direction (the width direction of the paper sheet). That is, at the guide member 111 that forms a part of the switchback conveying path 195 provided below the cooling fan 101, the slits 112 that enable the cooling air discharged from the discharge port 105, and the discharge ports 103 and 104 to pass into the switchback conveying path 195 are formed. The slits 112 are formed at a plurality of positions in the width direction of the paper sheet in the guide member 111. In FIGS. 5 and 6, 51 indicates a conveying path of the paper sheet. The paper sheet that underwent the fixing process performed by the fixing unit 13 is conveyed along the conveying path 157 and discharged to the discharge tray 151 by the discharge roller 158.

In addition, when double-sided printing is performed, the paper sheet that passed through the fixing unit 13 is guided to the switchback conveying path 190A (FIG. 1), and a conveying direction of the paper sheet is reversed (switched back) by the switchback roller 159 disposed at the end portion of the switchback conveying path 190A. The paper sheet is delivered from the switchback conveying path 190A to the switchback conveying path 195 and is conveyed again to an upstream region in the conveying direction.

As illustrated in FIGS. 5 and 6, the cooling air from the cooling fan 101 discharged from the discharge port 104 passes from the discharge port 105, and the discharge ports 103 and 104 and particularly, through the slit 112 from the discharge port 104, and reaches the conveying path 157 (an air flow S2). In addition, the cooling air from the cooling fan 101 discharged from the discharge port 103 and the discharge port 105 formed at the bottom of the concave portion 106 reaches the conveying path 157 even after passing air flows S3 and S4.

In addition, the cooling air from the cooling fan 101 discharged from the discharge port 108 formed at the branch destination of the duct 107 hits the switchback roller 159 (an air flow S5).

According to the embodiment, a part of the cooling air from the cooling fan 101 is discharged from the discharge ports 103 and 104 and the discharge port 105, and hits the conveying path 157 along which the paper sheet that underwent the fixing process is conveyed. On the other hand, another part of the cooling air from the cooling fan 101 is guided by the duct 107 in a direction toward the end portion of the conveying path 157 and the switchback conveying path 190A, which is different from a direction in which cooling air flows in the discharge ports 103 and 104, and the discharge port 105. In particular, in the present embodiment, a part of the cooling air from the cooling fan 101 is discharged from the discharge port 108 formed at the branch destination through the duct 107, and hits the switchback roller 159.

Accordingly, it is possible to cool a component arranged at the end portion of the conveying path 157, for example, the switchback roller 159, in addition to the paper sheet that underwent the fixing process, and the conveying path 157 along which the paper sheet is conveyed using the single the cooling fan 101. In addition, since the discharge port 108 accommodates the switchback roller 159, it is possible to cool the switchback roller 159 by the cooling air with high efficiency.

Accordingly, since the paper sheet after fixing is not only cooled when passing along the conveying path 157 but also cooled at the end portion of the switchback conveying path 190A and the conveying path 157 which discharges the paper sheet from the device body 11 (even when passing through the switchback roller 159), it is possible to efficiently prevent the paper sheet onto which the toner image is transferred from being discharged at a high temperature, and prevent moisture contained in the paper sheet from being evaporated to water vapor.

In addition, even when water vapor is generated and water droplets adhere to a component arranged at the end portion of the conveying path, for example, the end portion of the switchback conveying path 190A and the conveying path 157 itself, the discharge roller 158, or the switchback roller 159, since cooling air hits such a component, the water droplets adhered to such a component are dried, and it is possible to prevent the water droplets from accumulating.

In a general image forming device, in order to cool an inside or prevent water vapor from being generated therein, it is necessary to supply cooling air to the paper sheet itself or to a plurality of positions of components configured to convey the paper sheet. However, when a cooling fan is provided at respective locations for which cooling is necessary, there are problems in that the number of cooling fans to be installed increases and a cost increases. In addition, there are problems in that it is difficult to secure an installation location and a configuration is complicated.

On the other hand, according to the embodiment, it is possible to cool the paper sheet that underwent the fixing process and a conveying component with high efficiency using a single cooling fan.

What is claimed is:

1. An image forming device comprising:

a fixing unit configured to perform a process in which a toner image is fixed to a paper sheet after image formation;

a conveying path along which the paper sheet is conveyed toward the fixing unit and from the fixing unit;

a cooling fan disposed at a position facing the conveying path that is downstream relative to the fixing unit in a paper conveying direction;

a casing in which the cooling fan is accommodated;

a first discharge port that is formed in the casing and through which cooling air from the cooling fan is discharged toward a part of the conveying path that is upstream in the paper conveying direction relative to an end portion of the conveying path in the conveying path, which is downstream relative to the fixing unit; and a duct that guides the cooling air from the cooling fan in a direction toward the end portion of the conveying path, which is different from a direction in which the cooling air flows in the first discharge port.

2. The image forming device according to claim 1, wherein the first discharge port includes a furthest upstream discharge port, which is furthest upstream in the paper conveying direction, a furthest downstream discharge port, which is furthest downstream, and an intermediate discharge port provided at an intermediate position between the furthest upstream discharge port and the furthest downstream discharge port.

3. The image forming device according to claim 2, wherein:

in the casing, a concave portion that extends toward the conveying path along which the paper sheet that underwent a fixing process performed by the fixing unit is conveyed is further formed; and the furthest downstream discharge port is formed in the concave portion at a position facing the conveying path.

4. The image forming device according to claim 2, wherein, in the casing, the furthest upstream discharge port and the intermediate discharge port are formed at a center portion in a width direction of the paper sheet conveyed along the conveying path.

5. The image forming device according to claim 2, wherein the furthest downstream discharge port is formed in a width direction in the casing.

6. The image forming device according to claim 1, further comprising:

a discharge roller disposed at an end of the conveying path and configured to discharge the paper sheet conveyed from the fixing unit along the conveying path from a device body to the outside;

a switchback conveying path branched from the conveying path at a point that is upstream relative to the discharge roller in the paper conveying direction; and a switchback roller disposed at an end of the switchback conveying path in the paper conveying direction, wherein the duct guides the cooling air toward at least one of the discharge roller and the switchback roller.

7. The image forming device according to claim 6, wherein the duct guides the cooling air toward both the discharge roller and the switchback roller.

8. The image forming device according to claim 6, wherein the duct includes a second discharge port that is branched at a plurality of positions in a width direction of the paper sheet conveyed along the conveying path, which is a direction perpendicular to the paper conveying direction.

9. The image forming device according to claim 8, wherein the switchback roller is accommodated in the second discharge port.

10. The image forming device according to claim 9, wherein:

the switchback roller is provided to be divided at a plurality of positions in the width direction at a rotating shaft that extends in the width direction of the paper sheet;

the duct extends along the rotating shaft of the switchback roller; and the second discharge port is provided at a position at which each of the plurality of switchback rollers provided at the rotating shaft is disposed.

11. The image forming device according to claim 1, comprising:

an image forming unit configured to form an image on the paper sheet conveyed along the conveying path; and a switchback conveying path along which the paper sheet switched back by a switchback roller is conveyed again to a position that is upstream in the paper conveying direction relative to a position at which the image is formed by the image forming unit in the conveying path, wherein, in a guide member that is provided below the cooling fan and forms a part of the switchback conveying path, a slit that enables the cooling air discharged from the first discharge port to pass into the switchback conveying path is formed.

12. The image forming device according to claim 11, wherein the slit is formed at a plurality of positions in a width direction of the paper sheet in the guide member.

* * * * *